US009737117B2

(12) United States Patent
Nonogawa et al.

(10) Patent No.: US 9,737,117 B2
(45) Date of Patent: Aug. 22, 2017

(54) LACE FITTING STRUCTURE

(75) Inventors: Mai Nonogawa, Kobe (JP); Keizo Nakanishi, Kobe (JP)

(73) Assignee: Asics Corporation, Kobe-shi (JP)

( * ) Notice: Subject to any disclaimer, the term of this patent is extended or adjusted under 35 U.S.C. 154(b) by 234 days.

(21) Appl. No.: 14/384,656

(22) PCT Filed: Mar. 16, 2012

(86) PCT No.: PCT/JP2012/056878

§ 371 (c)(1),
(2), (4) Date: Sep. 11, 2014

(87) PCT Pub. No.: WO2013/136514

PCT Pub. Date: Sep. 19, 2013

(65) Prior Publication Data

US 2015/0026937 A1 Jan. 29, 2015

(51) Int. Cl.
*A43C 11/00* (2006.01)
*A43B 23/00* (2006.01)
(Continued)

(52) U.S. Cl.
CPC ..... *A43C 11/22* (2013.01); *A43C 1/00* (2013.01); *A43C 1/003* (2013.01); *A43C 1/006* (2013.01);
(Continued)

(58) Field of Classification Search
CPC ..... A43C 1/00; A43C 1/003; A43C 1/006; A43C 1/02; A43C 1/04; A43C 5/00
(Continued)

(56) References Cited

U.S. PATENT DOCUMENTS 712,003 A 10/1902 Payne
6,128,835 A 10/2000 Ritter et al.
(Continued)

FOREIGN PATENT DOCUMENTS

JP 33-3132 3/1958
JP 3-55710 U 5/1991
(Continued)

OTHER PUBLICATIONS

European Search Report issued in European Patent Application No. 12871336.9-1658, dated Nov. 3, 2015.
(Continued)

*Primary Examiner* — Khoa Huynh
*Assistant Examiner* — Timothy K Trieu
(74) *Attorney, Agent, or Firm* — Katten Muchin Rosenman LLP

(57) ABSTRACT

A lace fitting structure for fitting an upper 3 wrapping around an instep of a foot to the instep, the structure including: a medial side portion 31 covering the instep and a medial side surface of a big toe; a lateral side portion 32 covering the instep and a lateral side surface of a little toe; first shoelace means 1 placed to extend in a longitudinal direction Y of the foot and engaged with the medial side portion 31 and the lateral side portion 32 along central edge portions 33 of the medial side portion 31 and the lateral side portion 32; placement means for placing a portion of the first shoelace means 1 so that the first shoelace means 1 is exposed in a plurality of exposed areas $\mathbf{1}_i$, which are separated from one another in the longitudinal direction Y; and second shoelace means 2 engaging, in a transverse direction X of the foot, with the first shoelace means 1 in the plurality of exposed areas $\mathbf{1}_i$ so as to bring the medial side portion 31 and the lateral side portion 32 closer to each other, wherein a length L of the exposed areas $\mathbf{1}_i$ in the longitudinal direction Y is
(Continued)

greater than a thickness and a width of the second shoelace means 2.

13 Claims, 13 Drawing Sheets

(51) Int. Cl.

| | |
|---|---|
| ***A43C 11/22*** | (2006.01) |
| ***A43C 1/06*** | (2006.01) |
| ***A43C 1/00*** | (2006.01) |
| ***A43C 1/02*** | (2006.01) |
| ***A43C 1/04*** | (2006.01) |
| ***A43C 5/00*** | (2006.01) |

(52) U.S. Cl.
CPC ..... *A43C 1/02* (2013.01); *A43C 1/04* (2013.01); *A43C 1/06* (2013.01); *A43C 5/00* (2013.01); *Y10T 24/3737* (2015.01); *Y10T 24/3742* (2015.01); *Y10T 24/3787* (2015.01)

(58) Field of Classification Search
USPC ..... 36/50.1, 45
See application file for complete search history.

(56) References Cited

U.S. PATENT DOCUMENTS

| | | | | |
|---|---|---|---|---|
| D453,413 | S | 2/2002 | Tsujino et al. | |
| 6,601,323 | B2 | 8/2003 | Tsujino et al. | |
| D518,283 | S | 4/2006 | Kayano et al. | |
| 7,073,279 | B2 * | 7/2006 | Min ..... | A43C 1/003 24/712 |
| D527,174 | S | 8/2006 | Kayano et al. | |
| D527,516 | S | 9/2006 | Kayano et al. | |
| D528,761 | S | 9/2006 | Kayano et al. | |
| D552,833 | S | 10/2007 | Yamashita et al. | |
| D561,442 | S | 2/2008 | Kayano et al. | |
| D582,658 | S | 12/2008 | Fujita et al. | |
| 7,613,588 | B2 | 11/2009 | Katsu et al. | |
| D614,855 | S | 5/2010 | Inohara et al. | |
| D659,371 | S | 5/2012 | Yano et al. | |
| 8,272,148 | B2 | 9/2012 | Nishiwaki et al. | |
| 8,375,602 | B2 | 2/2013 | Takada et al. | |
| 2004/0148797 | A1 | 8/2004 | Nelson | |
| 2006/0005429 | A1 | 1/2006 | Min | |
| 2006/0283042 | A1 * | 12/2006 | Greene ..... | A43B 9/00 36/3 A |
| 2012/0011744 | A1 | 1/2012 | Bell et al. | |
| 2012/0124866 | A1 | 5/2012 | Moriyasu et al. | |
| 2012/0131818 | A1 | 5/2012 | Nishiwaki et al. | |
| 2013/0008053 | A1 | 1/2013 | Nishiwaki et al. | |
| 2013/0091731 | A1 * | 4/2013 | Wang ..... | A43B 13/14 36/99 |

FOREIGN PATENT DOCUMENTS

| | | | |
|---|---|---|---|
| JP | 3026562 | U | 7/1996 |
| JP | 2001046103 | A | 2/2001 |
| JP | 2005013365 | A | 1/2005 |

OTHER PUBLICATIONS

Asics Catalogue Titled "1999 Athletic Shoes Sporting Equipment" Issued in Dec. 1998.

* cited by examiner

LACE FITTING STRUCTURE

CROSS-REFERENCE TO RELATED APPLICATIONS

This patent application is a U.S. National Phase application under 37 U.S.C. §371 of Patent Cooperation Treaty Application No. PCT/JP2012/056878, filed on Mar. 16, 2012, entitled "Lace-Up Fitting Structure," the contents of which are incorporated herein by reference in entirety.

TECHNICAL FIELD

The present invention relates to a shoe having a lace fitting structure.

BACKGROUND ART

A shoelace fits an upper to the foot. The upper, fitted to the foot, supports the foot.

However, when the MP joint is dorsiflexed, the shape of the foot changes, thereby also changing the foot circumference. When a shoe is worn over a long time, the foot circumference often increases. In such a case, the foot in the shoe will be compressed by the upper. Also, slippage often occurs between the shoe and the foot during movement.

Particularly, the middle foot section of the foot substantially changes its shape as the posture changes. If the upper, which is fitted to the foot when standing still, fails to follow changes of the shape of the foot, the fit between the upper and the foot significantly deteriorates during movement.

CITATION LIST

Patent Literature

First Patent Document: JP2005-13365A (Abstract)
Second Patent Document: JP2001-46103A (Abstract)

SUMMARY OF INVENTION

In the shoe of the first patent document, a plurality of loop members for passing a shoelace therethrough are fixed to the upper end of the sole, and the sole is likely to fit to the sole of the foot, but the upper will not sufficiently fit to the foot. In the shoe of the first patent document, a plurality of loops for passing a shoelace therethrough are passing around the back surface of the heel, and therefore the heel portion of the upper is likely to fit to the foot, but the upper will not sufficiently fit to the foot in the area anterior to the top-line (mouth).

It is therefore an object of the present invention to provide a shoe lacing structure with which the upper is likely to fit to the foot in the middle foot section.

In one aspect thereof, the present invention is directed to a lace fitting structure for fitting an upper wrapping around an instep of a foot to the instep, the structure including:

a medial side portion covering medial side surfaces of the instep and a big toe;

a lateral side portion covering lateral side surfaces of the instep and a little toe;

a first shoelace means placed to extend in a longitudinal (front-rear) direction of the foot and engaged with the medial side portion and the lateral side portion along central edge portions of the medial side portion and the lateral side portion;

a placement means for placing a portion of the first shoelace means so that the first shoelace means is exposed in a plurality of exposed areas, which are separated from one another in the longitudinal direction; and a second shoelace means engaging, in a transverse direction of the foot, with the first shoelace means in the plurality of exposed areas so as to bring the medial side portion and the lateral side portion closer to each other, wherein a length of each of the exposed areas in the longitudinal direction is greater than a thickness and a width of the second shoelace means.

Herein, the shoelace means is composed of one or more string that can be used as a shoelace, and includes one or more string obtained by weaving natural yarns or synthetic polymer yarns or one or more string made of a natural leather or a synthetic leather, and it further means to include a metal wire. Note however that it is preferred that a metal wire is not included.

According to the present invention, lacing apertures for passing the second shoelace means therethrough are formed by exposed areas of the first shoelace means, and since the length of the exposed area in the longitudinal direction is greater than the width or the thickness of the second shoelace means, the engagement position at which the second shoelace means engages with the first shoelace means can be displaced in the longitudinal direction. This makes it possible to accommodate changes of the shape of the foot following changes of the foot shape and the posture of the wearer, and the upper is likely to fit to the foot with a uniform pressure, avoiding local tightening.

The medial side portion and the lateral side portion are pulled, via the central edge portions thereof, toward the center by the second shoelace means, and therefore the medial side portion and the lateral side portion of the upper are likely to fit to the foot.

In another aspect thereof, the present invention is directed to a lace fitting structure for fitting an upper wrapping around an instep of a foot to the instep, the structure including:

a medial side portion covering medial side surfaces of the instep and a big toe;

a lateral side portion covering lateral side surfaces of the instep and a little toe;

a first shoelace means placed to extend in a longitudinal direction of the foot, along central edge portions of the medial side portion and the lateral side portion, and anterior to a top-line (mouth) through which the foot is inserted into the upper, the first shoelace means engaged with the medial side portion at a plurality of locations and engaged with the lateral side portion at a plurality of locations;

a placement means for placing a first portion of the first shoelace means on a medial side of the foot anterior to the top-line so that the first portion is exposed in a plurality of medial exposed areas, separated from one another in the longitudinal direction, and for placing a second portion of the first shoelace means on a lateral side of the foot anterior to the top-line so that the second portion is exposed in a plurality of lateral exposed areas, separated from one another in the longitudinal direction; and a second shoelace means engaging, in a transverse direction of the foot, with the first shoelace means in the plurality of medial and lateral exposed areas so as to bring the medial side portion and the lateral side portion closer to each other, wherein a length of each of the medial and lateral exposed areas in the longitudinal direction Y is greater than a thickness and a width of the second shoelace means.

In such a case, a plurality of exposed areas are placed anterior to the top-line, and therefore the medial side portion and the lateral side portion of the upper are likely to fit to the foot anterior to the top-line.

DESCRIPTION OF EMBODIMENTS

Figure 1:
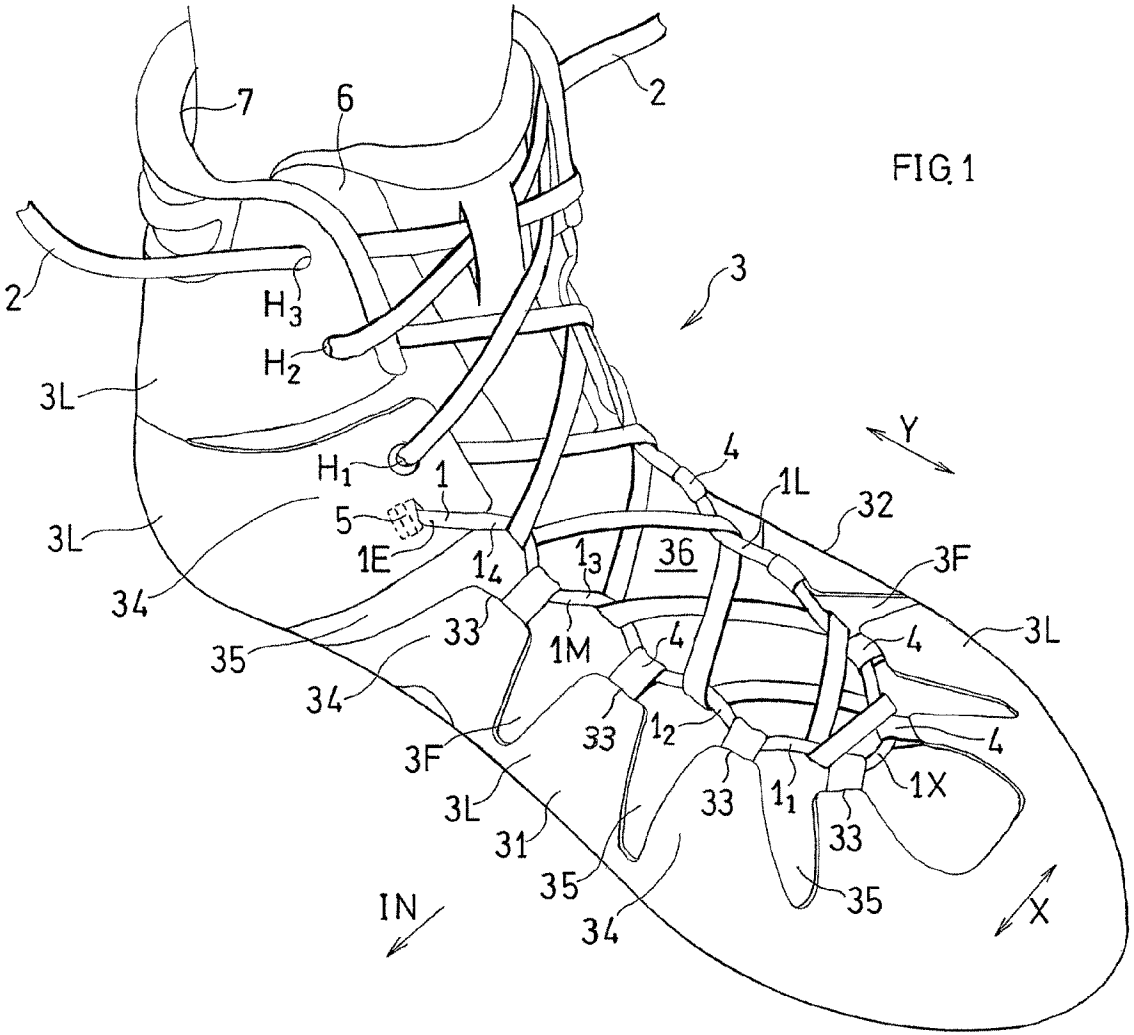
FIG. 1 is a schematic perspective view showing an upper according to Embodiment 1 of the present invention, as seen from a diagonally front and medial side.

Preferably, the placement means includes:

two or more loop members 4 placed along each of the central edge portions 33 of the medial side portion 31 and the lateral side portion 32, the loop members 4 being pierced therethrough in the longitudinal direction Y, and the first shoelace means 1 being inserted through the loop members 4 so as to be movable in the longitudinal direction Y; and secured portions 5 for securing end portions 1E of the first shoelace means 1 in front portions of the medial side portion 31 and the lateral side portion 32 or in rear portions of the medial side portion 31 and the lateral side portion 32.

In such a case, the first shoelace means 1 passing through a plurality of loop members 4 is movable in the longitudinal direction Y, and therefore when the first shoelace means 1 is pulled by the second shoelace means 2, the first shoelace means 1 can be bent substantially in the exposed areas $\mathbf{1}_i$. Therefore, the effective positions of lacing apertures can be displaced not only in the longitudinal direction Y but also in the transverse direction X as the shape of the foot changes.

More preferably, the plurality of exposed areas $\mathbf{1}_1$ to $\mathbf{1}_n$ include an anterior exposed area and a posterior exposed area posterior to the anterior exposed area, and a length of the posterior exposed area in the longitudinal direction Y is greater than a length of the anterior exposed area in the longitudinal direction Y.

While the second shoelace means 2 is fastened by being pulled from the toe side of the upper toward the ankle, there are greater individual differences in the height of the instep, and the distance between medial and lateral edge portions is larger, near the ankle as compared with the toe. Therefore, the engagement position of the second shoelace means 2 will vary more in the posterior exposed area, as compared with the anterior exposed area.

As the length $L_i$ of the posterior exposed area is greater than that of the anterior exposed area, greater variations of the engagement position can be accommodated.

Note that the length $L_i$ of an exposed area does not always need to be as long as the posterior exposed area.

More preferably, the length of the posterior exposed area is greater than the length of the anterior exposed area by 2 mm or more. Note that the difference in length $L_i$ is more preferably 3 mm or more, and most preferably 4 mm or more, and it is preferably 30 mm or less.

In this case, no distinct difference may be observed if the difference in length $L_i$ is less than 2 mm.

More preferably, the plurality of exposed areas $\mathbf{1}_1$ to $\mathbf{1}_n$ include $1^{st}$ to $n^{th}$ areas $\mathbf{1}_1$ to $\mathbf{1}_n$ arranged from the front portion to the rear portion and separated from one another in the longitudinal direction Y, and a length $L_{i+1}$ in the longitudinal direction Y of an arbitrary $(i+1)^{th}$ area $\mathbf{1}_{i+1}$ from an anterior side is greater than a length $L_i$ in the longitudinal direction Y of an arbitrary $i^{th}$ area $\mathbf{1}_i$ from the anterior side.

That is, a more posterior exposed area preferably has a greater length $L_i$, which can be mathematically represented as in Expression (1) below.

$$L_1<L_2 \ldots <L_i<L_{i+1} \ldots <L_n \quad (1)$$

In such a case, variations of the engagement position can be accommodated more easily.

More preferably, the medial side portion 31 and the lateral side portion 32 are each provided with a through hole H which is running through the medial side portion 31 or the lateral side portion 32 in a thickness direction thereof and through which the second shoelace means 2 is inserted; and the through holes H are placed posterior to a most posterior one of the plurality of loop members 4.

In such a case, at locations near the through holes H formed in the medial side portion 31 and the lateral side portion 32, the second shoelace means 2 passes under the fabric of the medial side portion 31 or the lateral side portion 32, thus resulting in a large frictional force with the fabric. Therefore, the second shoelace means 2 can be tied easily while maintaining the degree of tightness which has been set by the wearer.

In another preferred embodiment, the first shoelace means 1 is formed by one or two round strings, and the second shoelace means 2 is formed by one or two belt-like (flat) strings.

In this case, if the shoelace means 1 and 2 are both round strings, the shoelace thickness (height) at engagement locations increases, thereby detracting from the compactness of the upper.

On the other hand, if the shoelace means 1 and 2 are both belt-like (flat), the first shoelace means 1 is likely to be twisted at engagement locations between the shoelace means 1 and 2, thereby detracting from the aesthetic appearance.

In contrast, if the first shoelace means 1 is a round string and the second shoelace means 2 is belt-like, there will be no such drawbacks, and the second shoelace means 2 slides smoothly against the first shoelace means 1, thus likely preventing local tightening.

In another preferred embodiment, the first shoelace means 1 is formed by at least one string formed in a U-shaped pattern having a third portion 1X, the third portion 1X extending in the transverse direction X and connecting between the first portion 1M and the second portion 1L.

In this case, the structure will be simple.

In another preferred embodiment, the first shoelace means 1 is formed by two strings formed in a U-shaped pattern having a third portion 1X, the third portion 1X extending in the transverse direction X and connecting between the first portion 1M and the second portion 1L, wherein one of the two strings is placed on a toe side and another one of the two strings is placed on a top-line side.

In this case, the toe-side string and the top-line side string have different rigidities and tensions, thereby making it easier to have different degrees of tightness on the toe side and on the top-line side.

Preferably, the upper includes:

a stretchable member 3F which covers the medial side surface and the lateral side surface of the instep of the foot in an area anterior to a most posterior one of the loop members 4, the stretchable member 3F being stretchable in the longitudinal direction Y and the transverse direction X;

a non-stretchable member 3L which is attached to a surface of the stretchable member 3F, is less stretchable than the stretchable member 3F, and forms a portion of the medial side portion 31 and the lateral side portion 32;

a plurality of protruding portions 34 of the non-stretchable member 3L projecting toward a center of the instep of the foot, the protruding portions 34 being provided by a wave-shape formation of upper-end edge portions 33 of the non-stretchable member 3L in the medial side portion 31 and the lateral side portion 32; and a soft portion 35 between protruding portions 34 adjacent to each other, which is not covered by the non-stretchable member 3L and in which the stretchable member 3F is exposed, wherein the loop members 4 are provided at the edge portions 33 of the protruding portions 34.

With the present lacing structure, the upper is more likely to fit to the foot in a case where the protruding portions 34 are displaced in the longitudinal direction Y of the foot through the tightening of the second shoelace means 2, as compared with a case where they are not displaced in the longitudinal direction Y.

In the present embodiment, the stretchable member 3F deforms in accordance with the size and the movement of the foot, and further the protruding portions 34 of the non-stretchable member 3L are displaced in the longitudinal direction Y, thereby making it likely that the medial side portion 31 and the lateral side portion 32 fit to the foot.

More preferably, each protruding portion 34 is formed in a trapezoidal shape tapered upwardly.

In this case, the upper is even more likely to fit to the foot.

More preferably, a length of the soft portion 35 in the longitudinal direction Y between the protruding portions 34 and 34 adjacent to each other becomes greater as the soft portion 35 extends toward a center of the foot.

In this case, the soft portion 35 of the stretchable member 3F easily deforms, and therefore the protruding portion 34 will likely fit to the medial side surface and the lateral side surface of the foot.

More preferably, in an area anterior to a most posterior one of the loop members 4, the upper 3 is formed sock-shaped, being continuous in a foot circumference direction (the circumferential direction).

In this case, the sock-shaped stretchable member 3F will likely fit to the foot.

In still another aspect, the present invention is directed to a lace fitting structure for fitting an upper wrapping around an instep of a foot to the instep, the structure including:

a medial side portion 31 covering medial side surfaces of the instep and a big toe;

a lateral side portion 32 covering lateral side surfaces of the instep and a little toe;

a shoelace means 2 for bringing the medial side portion 31 and the lateral side portion 32 closer to each other; and an engagement means 1 having a plurality of engagement areas $\mathbf{1}_i$ which are provided along central edge portions 33 of the medial side portion 31 and the lateral side portion 32 in which the shoelace means 2 engages with the engagement means 1, wherein a length of each of the engagement areas in a longitudinal direction Y of the foot is greater than a thickness of the shoelace means 2, and the engagement means 1 is bent by being pulled by the shoelace means 2 in the engagement areas $\mathbf{1}_i$, wherein the plurality of engagement areas $\mathbf{1}_i$ include an anterior engagement area $\mathbf{1}_i$, and a posterior engagement area $\mathbf{1}_i$ posterior to the anterior engagement area $\mathbf{1}_i$, and a length of the posterior engagement area $\mathbf{1}_i$ in the longitudinal direction Y is greater than a length of the anterior engagement area $\mathbf{1}_i$ in the longitudinal direction Y.

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

EMBODIMENTS

Embodiment 1

Embodiment 1 of the present invention will now be described with reference to FIGS. 1 to 6B.

An upper for the left foot will be illustrated in the following description. In the following figures, the arrow OUT represents the lateral side direction of the foot, and the arrow IN represents the medial side direction of the foot.

A shoe having a lace fitting structure shown in FIG. 1 is for example a high-cut wrestling shoe, and includes a sole (not shown), an upper 3, and first and second shoe laces 1 and 2.

The sole is placed under the upper 3, and is to be in contact with the road surface. The upper 3 wraps around the instep of the foot, and includes a tongue 6. The shoelaces 1 and 2 are for fitting the upper 3 to the instep of the foot.

Figure 2:
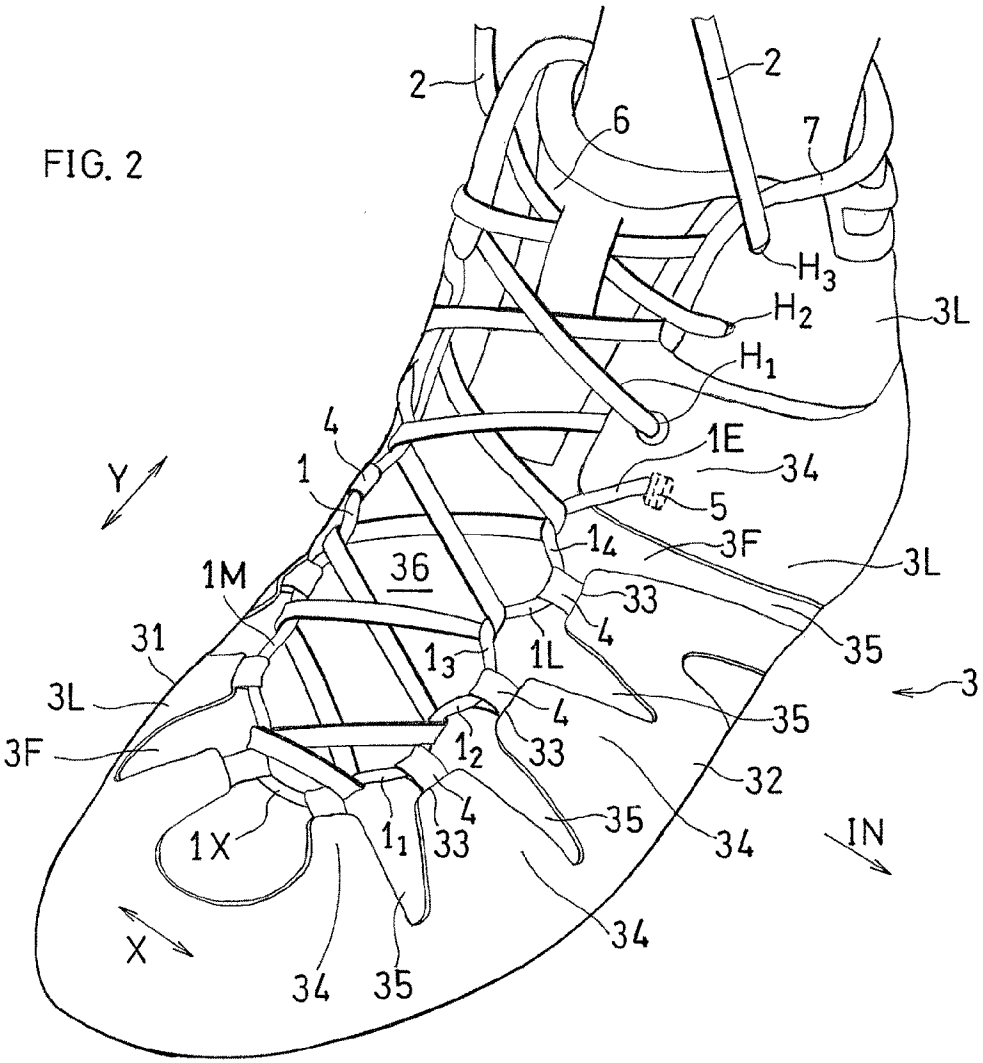
FIG. 2 is a schematic perspective view showing the upper according to Embodiment 1 of the present invention, as seen from a diagonally front and lateral side.

Although the opposite end portions of the second shoelace 2 are not shown in FIGS. 1 and 2, the opposite end portions are tightly tied together after the foot is inserted into the upper 3. As the end portions of the second shoelace 2 are tied together, the upper 3 fits to the foot.

As shown in FIGS. 1 and 2, the upper 3 is provided with a top-line (mouth) 7 through which the foot is inserted when putting on. The top-line 7 is a part through which the leg protrudes upward while worn, and the location anterior to the top-line 7 is covered by the tongue 6.

Figure 3:
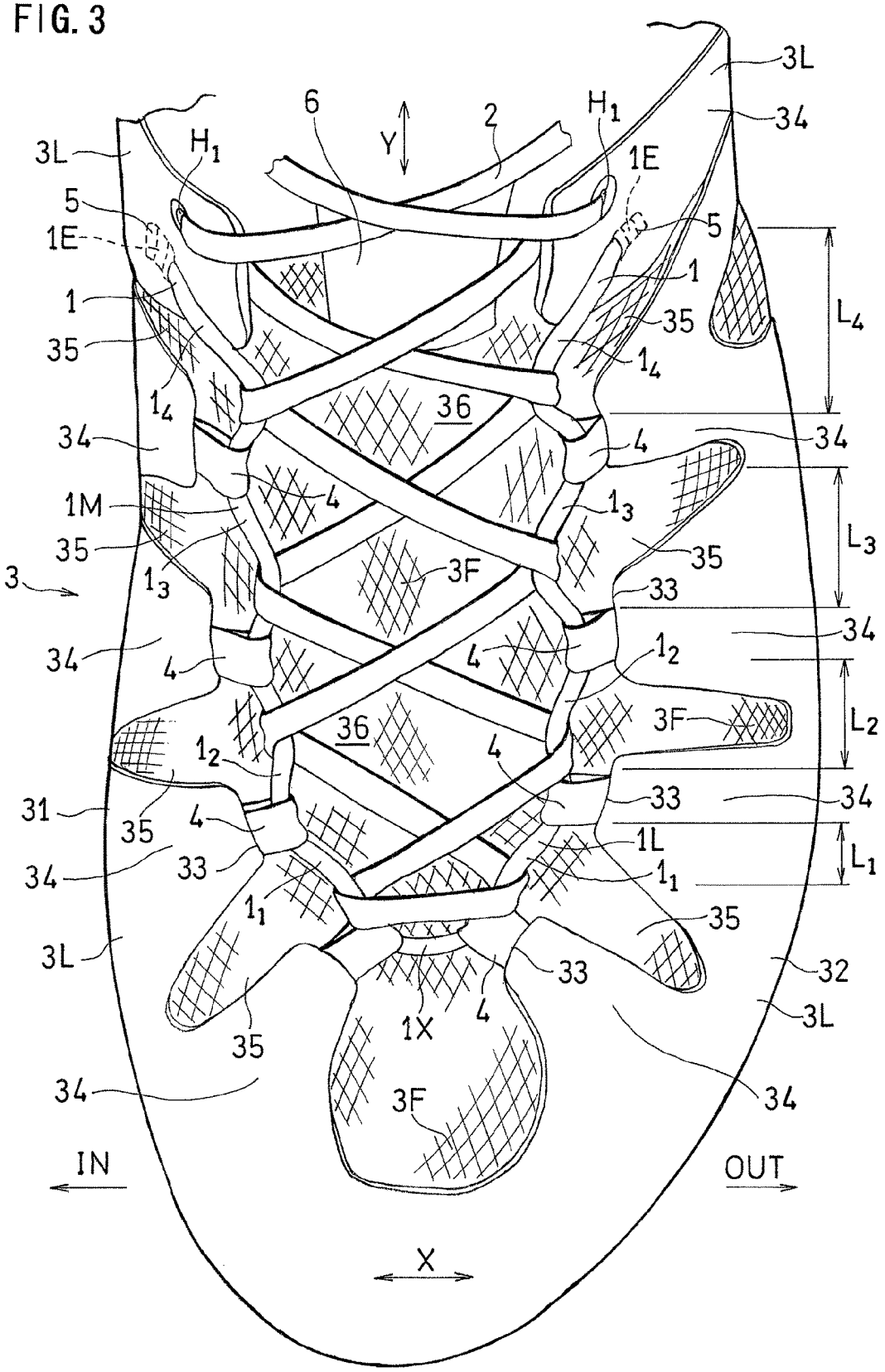
FIG. 3 is a plan view showing a middle foot portion and a front foot portion of the upper as the upper is worn on the foot of a first wearer.
Figure 6A:
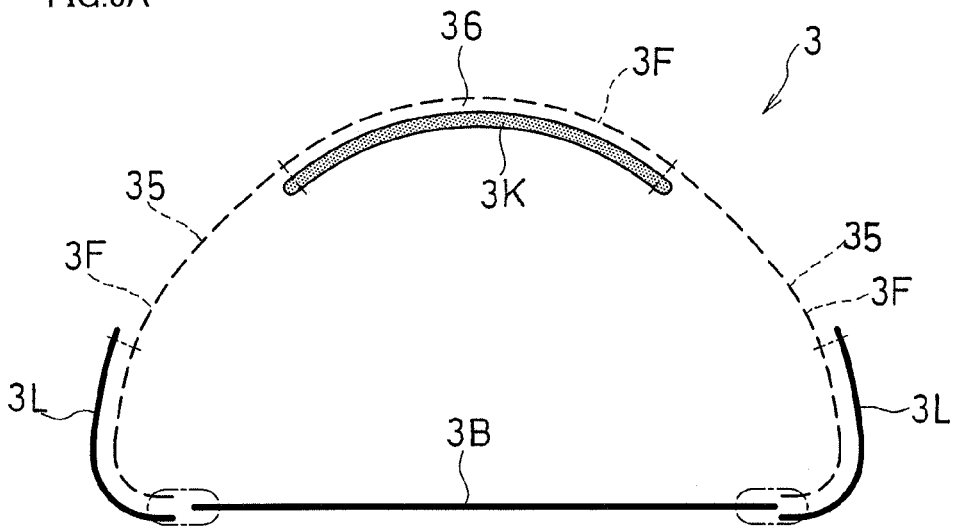
FIG. 6A is a diagram showing a cross section of the upper taken along a soft portion.
Figure 6B:
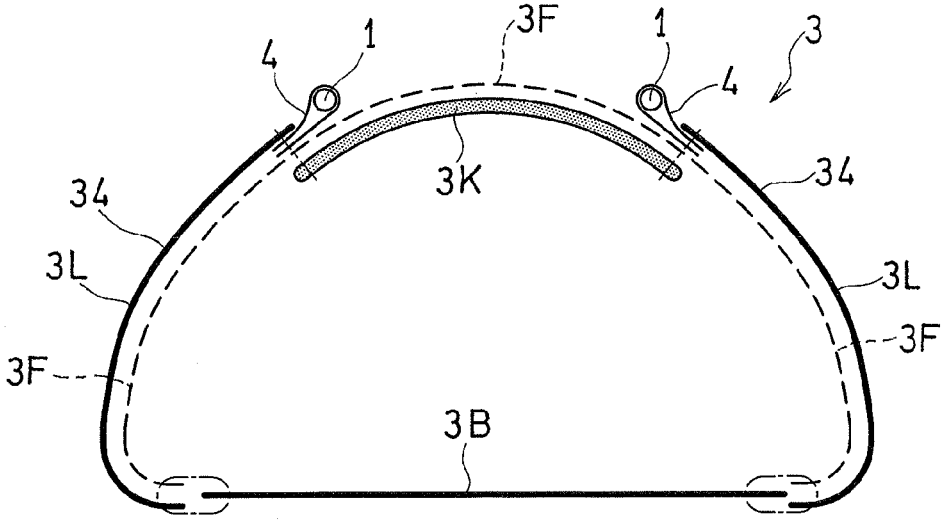
FIG. 6B is a diagram showing a cross section of the upper taken along a protruding portion.

In FIG. 3, the upper 3 includes the stretchable member 3F covering the instep from above and the non-stretchable member 3L, and includes a bottom member 3B covering the bottom surface of the sole of the foot as shown in FIGS. 6A and 6B and sewn to the stretchable member 3F and the non-stretchable member 3L. The bottom member 3B may be formed by a fabric that is stretchable in the width direction of the foot, for example.

Note that in FIGS. 6A and 6B, the stretchable member 3F is drawn by a broken line, and the non-stretchable member 3L is drawn by a thick solid line.

As shown in FIGS. 6A and 6B, the stretchable member 3F covers the upper surface, the medial side surface, and the lateral side surface of the instep of the foot. The stretchable member 3F is a meshed member, for example, and is stretchable in the longitudinal direction Y and the transverse direction X of FIG. 3.

As shown in FIGS. 6A and 6B, in the present embodiment, a cushion member 3K stretchable in the longitudinal direction Y and the transverse direction X is placed under the stretchable member 3F. The cushion member 3K is in contact with the upper surface of the instep in an area where the first shoelace 1 (FIG. 3) is placed.

A portion of the non-stretchable member 3L of FIGS. 1 and 2, e.g., a portion of the non-stretchable member 3L that is placed anterior to or below the ankle, is attached by sewing to at least a portion of the surface of the stretchable member 3F. On the other hand, a portion of the non-stretchable member 3L at a location covering the ankle is attached by sewing to the stretchable member 3F only at its lower end or its rear end, and is movable with respect to the tongue 6 and the soft portions 35.

The non-stretchable member 3L is made of a synthetic leather, for example, to be less stretchable than the stretchable member 3F, and forms a portion of the medial side portion 31 and the lateral side portion 32.

As shown in FIG. 3, portions of the stretchable member 3F that are not covered by the non-stretchable member 3L are exposed, and are partially cross-hatched in FIG. 3.

The upper 3 includes a plurality of protruding portions 34 and soft portions 35. The plurality of protruding portions 34 of the non-stretchable member 3L are projecting toward the center of instep of the foot due to the wave-shape formation of the upper-end edge portions 33 of the non-stretchable member 3L in the medial side portion 31 and the lateral side portion 32.

The soft portions 35 are portions of the stretchable member 3F between protruding portions 34 adjacent to each other that are not covered by the non-stretchable member 3L and are exposed.

Note that the stretchable member 3F is exposed also in the location between the medial side portion 31 and the lateral side portion 32, i.e., in the central portion 36 of the instep.

In FIGS. 1 and 2, the protruding portion 34 is formed in a rectangular shape or a trapezoidal shape tapered upwardly (toward the center between the medial side and the lateral side). Therefore, some of the soft portions 35 between protruding portions 34 and 34 adjacent to each other has a greater length in the longitudinal direction Y toward the center of the foot.

The medial side portion 31 of FIG. 3 covers the medial side surfaces of the instep and the big toe.

The lateral side portion 32 covers the lateral side surfaces of the instep and the little toe.

A loop member 4 is secured (sewn) to the upper-end edge portion 33 of each protruding portion 34. Two or more loop members 4 are placed along each of the central edge portions 33 of the medial side portion 31 and the lateral side portion 32, the loop members 4 being pierced therethrough in the longitudinal direction Y. The first shoelace 1 is inserted through the loop members 4 so as to be movable in the longitudinal direction Y.

The first shoelace 1 is placed in a generally U-shaped pattern, for example, and the opposite end portions 1E thereof are secured by sewing to the non-stretchable member 3L at secured portions 5.

Note that in the present embodiment, the secured portions 5 are provided in the rear portions of the medial side portion 31 and the lateral side portion 32, i.e., in the vicinity of the top-line 7 (FIG. 1).

The first shoelace 1 is placed to extend in the longitudinal direction Y of the foot, along the central edge portions 33 of the medial side portion 31 and the lateral side portion 32, and anterior to the top-line 7 (FIG. 1) through which the foot is inserted into the upper, the first shoelace 1 engaged with the medial side portion 31 via a plurality of loop members 4 and engaged with the lateral side portion 32 via a plurality of loop members 4.

Thus, portions of the first shoelace 1 are placed while being exposed in a plurality of exposed areas $\mathbf{1}_i$ separated from one another in the longitudinal direction Y.

The plurality of loop members 4 and the secured portions 5 together form the placement means. That is, on the medial side of the foot anterior to the top-line 7 (FIG. 1), a first portion 1M of the first shoelace 1 is placed while being exposed in a plurality of exposed areas $\mathbf{1}_i$ separated from one another in the longitudinal direction Y. On the lateral side of the foot anterior to the top-line 7 (FIG. 1), a second portion 1*b* of the first shoelace 1 is placed while being exposed in a plurality of exposed areas $\mathbf{1}_i$ separated from one another in the longitudinal direction Y.

Thus, the first shoelace 1 forms lacing apertures for the second shoelace 2. That is, in the plurality of exposed areas $\mathbf{1}_i$, the second shoelace 2 engages alternately with the first portion 1M and the second portion 1L of the first shoelace 1 in the transverse direction X of the foot, bringing the medial side portion 31 and the lateral side portion 32 closer to each other.

In the present embodiment, the first shoelace 1 is formed by one round string, and the second shoelace 2 is formed by one belt-like string. Herein, the length $L_i$ of each exposed area $\mathbf{1}_i$ in the longitudinal direction Y is greater than the width of the second shoelace 2.

Note that where the second shoelace 2 is a round string, the length $L_i$ in the longitudinal direction Y needs to be greater than the thickness of the second shoelace 2.

The first shoelace 1 may be a belt-like string, like the second shoelace 2, rather than a round string.

In FIG. 3, the plurality of exposed areas $\mathbf{1}_i$ include $1^{st}$ to $n^{th}$ areas $\mathbf{1}_1$ to $\mathbf{1}_n$ arranged from the front portion to the rear portion and separated from one another in the longitudinal direction Y, and the length $L_{i+1}$ in the longitudinal direction Y of an arbitrary $(i+1)^{th}$ area $\mathbf{1}_{i+1}$ from the anterior side is greater than the length $L_i$ in the longitudinal direction Y of an arbitrary $i^{th}$ area $\mathbf{1}_i$ from the anterior side by 2 mm or more, for example.

That is, in the present embodiment, Expressions (11) to (13) below are satisfied.

$$2+L_1<L_2 \tag{11}$$

$$2+L_2<L_3 \tag{12}$$

$$2+L_{n-1}<L_n \tag{13}$$

In such a case, variations of the engagement position of the second shoelace 2 can be accommodated more easily.

However, in the present invention, variations of the engagement position can be accommodated also when Expression (20) below is satisfied.

$$2+L_i<L_{i+j} \quad (20)$$

That is, the plurality of exposed areas $\mathbf{1}_i$ include an anterior exposed area $\mathbf{1}_i$, and a posterior exposed area $\mathbf{1}_{i+j}$ posterior to the anterior exposed area $\mathbf{1}_i$, and the length of at least one posterior exposed area $\mathbf{1}_{i+j}$ in the longitudinal direction Y is greater than the length of at least one anterior exposed area $\mathbf{1}_i$ in the longitudinal direction Y.

As shown in FIGS. 1 and 2, the medial side portion 31 and the lateral side portion 32 are each provided with three through holes $H_1$ to $H_3$. The through holes H are running through the medial side portion 31 or the lateral side portion 32 in the thickness direction thereof, and the second shoelace 2 is inserted therethrough. The through holes $H_1$ to $H_3$ are placed posterior to the most posterior one of the loop members 4.

Note that an eyelet member E is attached to the through hole $H_1$.

The inner diameter of the posterior through holes $H_2$ and $H_3$ may be smaller than the width of the first shoelace 1.

Next, in order to clarify the effect of the present structure, cases where the same upper 3 is worn by three, first to third, wearers having different foot shapes and sizes from one another will be described with reference to FIGS. 3 to 5.

The foot sizes of the wearers are as follows.

FIG. 3: First wearer: 25.5 cm

Figure 4:
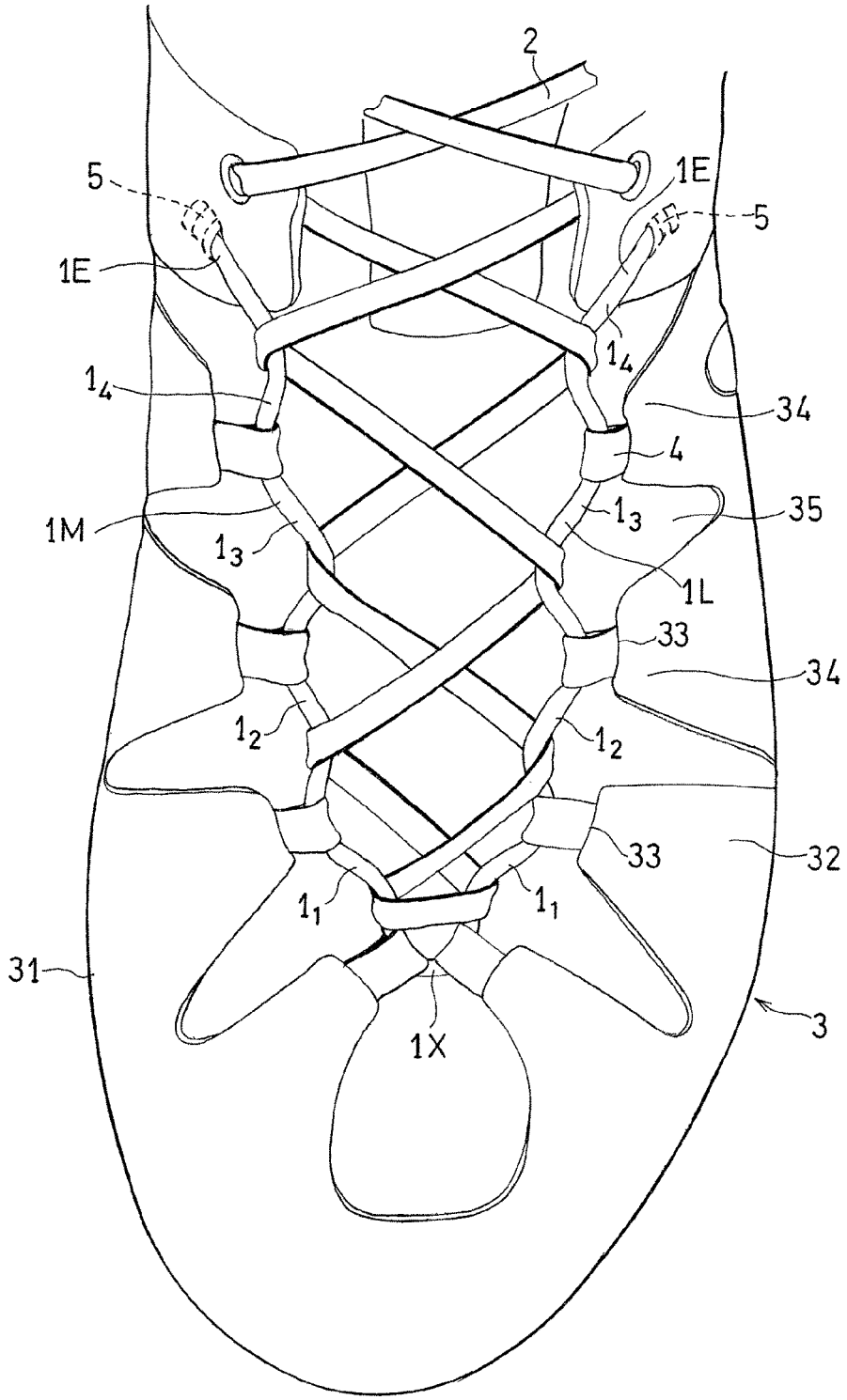
FIG. 4 is a plan view showing a middle foot portion and a front foot portion of the upper as the upper is worn on the foot of a second wearer.

FIG. 4: Second wearer: 23.5 cm

Figure 5:
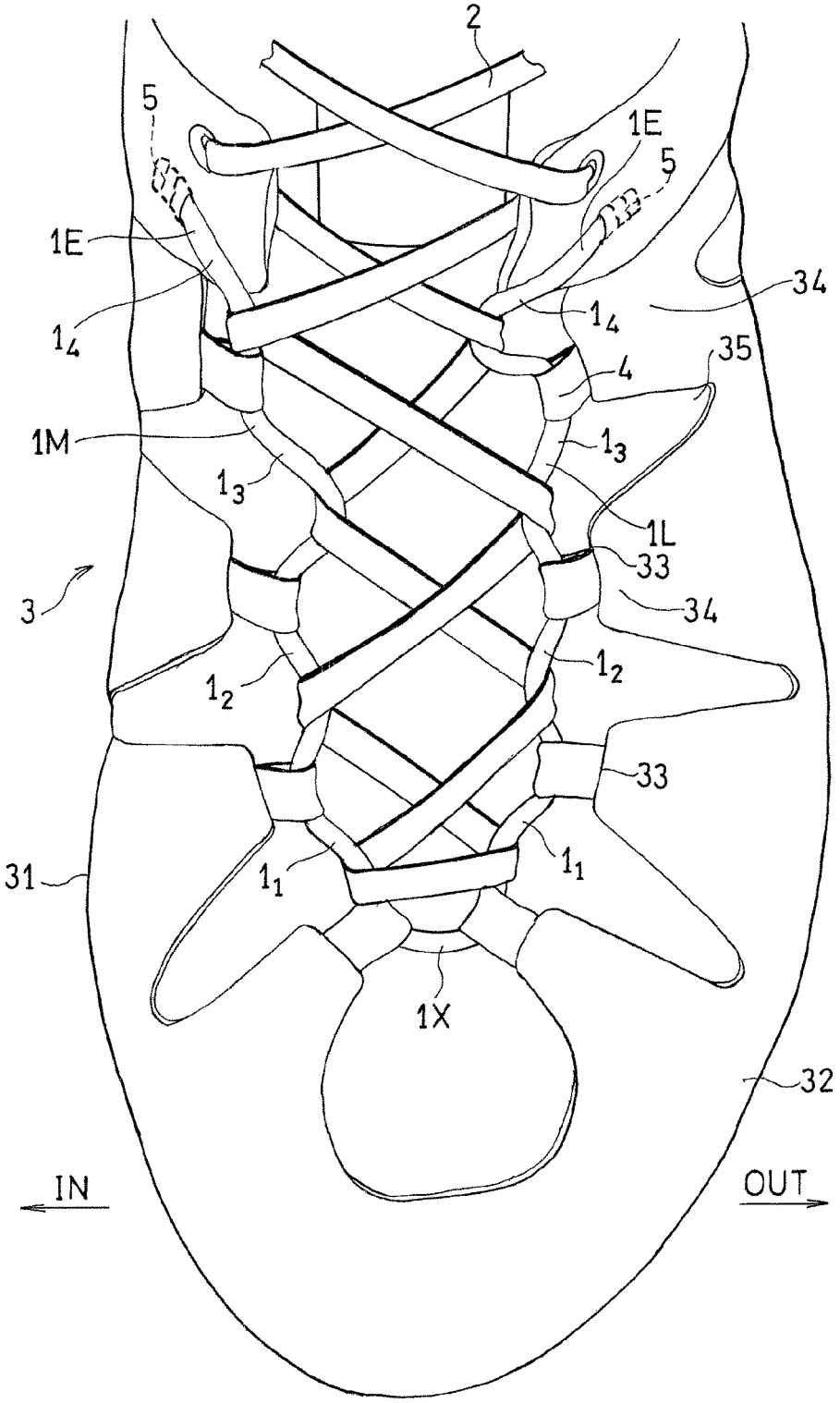
FIG. 5 is a plan view showing a middle foot portion and a front foot portion of the upper as the upper is worn on the foot of a third wearer.

FIG. 5: Third wearer: 26.0 cm (thin body type)

Through comparison between FIGS. 3 to 5, one will be able to perceive (visually grasp) that the engagement position of the second shoelace 2 in the anterior exposed area $\mathbf{1}_i$ is generally constant, whereas the engagement position of the second shoelace 2 in the posterior exposed area $\mathbf{1}_3$ or the most posterior exposed area $\mathbf{1}_4$ varies substantially.

Therefore, by setting the length $L_i$ to be larger for more posterior exposed areas $\mathbf{1}_i$, the fit of the upper 3 is expected to improve.

Through comparison between FIGS. 3 to 5, one will be able to perceive that the degree of bending of the first shoelace 1 in the exposed areas $\mathbf{1}_i$ substantially differs from one another. For example, in FIG. 5, the first shoelace 1 is significantly substantially bent in the posterior exposed area $\mathbf{1}_3$ on the medial side of the foot and in the most posterior exposed area $\mathbf{1}_4$ on the lateral side of the foot.

It can be seen that with the bending, the soft portions 35 corresponding to the substantially-bent exposed areas $\mathbf{1}_3$ and $\mathbf{1}_4$ are shrunk substantially in the longitudinal direction Y. That is, shrinking of the soft portions 35 in the longitudinal direction Y allows the first shoelace 1 in the exposed area $\mathbf{1}_i$ to bend, thereby allowing the engagement position of the second shoelace 2 for the exposed area $\mathbf{1}_i$ to be displaced not only in the longitudinal direction Y but also in the transverse direction X. Therefore, the upper 3 will likely follow changes of the shape of the foot during movement.

Next, other embodiments will be described.

Note that in the following embodiments, like elements to those of Embodiment 1 will be denoted by like reference numerals and will not be described in detail or illustrated in the figure, and what are different from Embodiment 1 will be illustrated and described.

Figure 7:
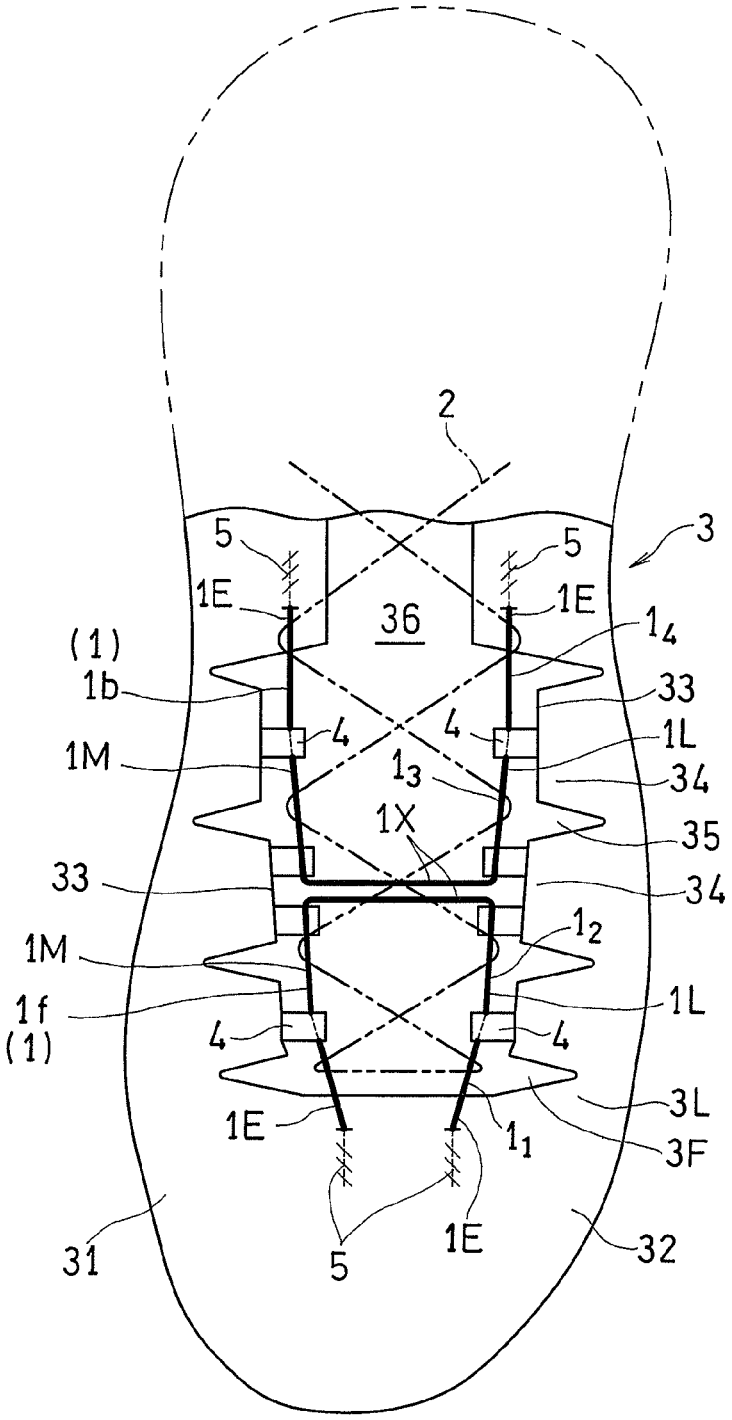
FIG. 7 is a conceptual plan view showing a lacing structure according to Embodiment 2.

FIG. 7 shows a structure of Embodiment 2.

In the present embodiment, the first shoelace means 1 is formed by two shoelaces, i.e., a front shoelace 1*f* and a rear shoelace 1*b*. In this case, it may be possible to control the degree of tightness to be achieved by the second shoelace 2 based on the rigidity, tension, length, etc., of the two shoelaces 1*f* and 1*b*.

Note that in the embodiment of FIG. 7, the front shoelace 1*f* is secured at secured portions 5 in the front portion of the upper 3, and the rear shoelace 1*b* is secured at secured portions 5 in the rear portion of the upper 3.

Figure 8:
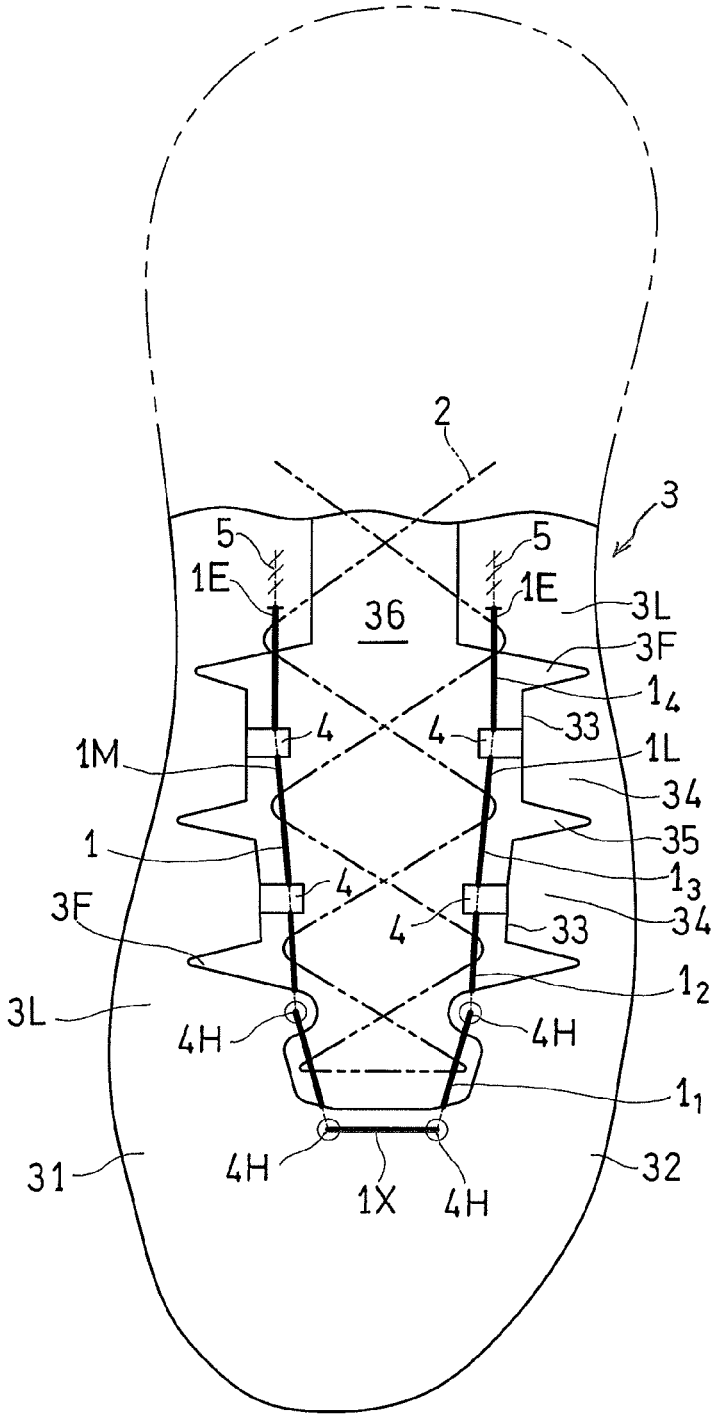
FIG. 8 is a conceptual plan view showing a lacing structure according to Embodiment 3.

FIG. 8 shows a structure of Embodiment 3.

In the present embodiment, the medial side portion 31 and the lateral side portion 32 are provided with through holes 4H through which the first shoelace 1 is inserted.

The first shoelace 1 is inserted in an upward direction through the through holes 4H, and therefore the first shoelace 1 comes into contact with the lower surface of the medial side portion 31 or the lateral side portion 32. Thus, it receives a large frictional resistance force, and the free movement and bending of the first shoelace 1 will be more prevented in the exposed area $\mathbf{1}_1$ anterior to the through holes 4H than in the other exposed areas $\mathbf{1}_2$ to $\mathbf{1}_4$. Therefore, it may be possible to prevent the toe from being too tightened as shown in FIG. 4.

Figure 9:
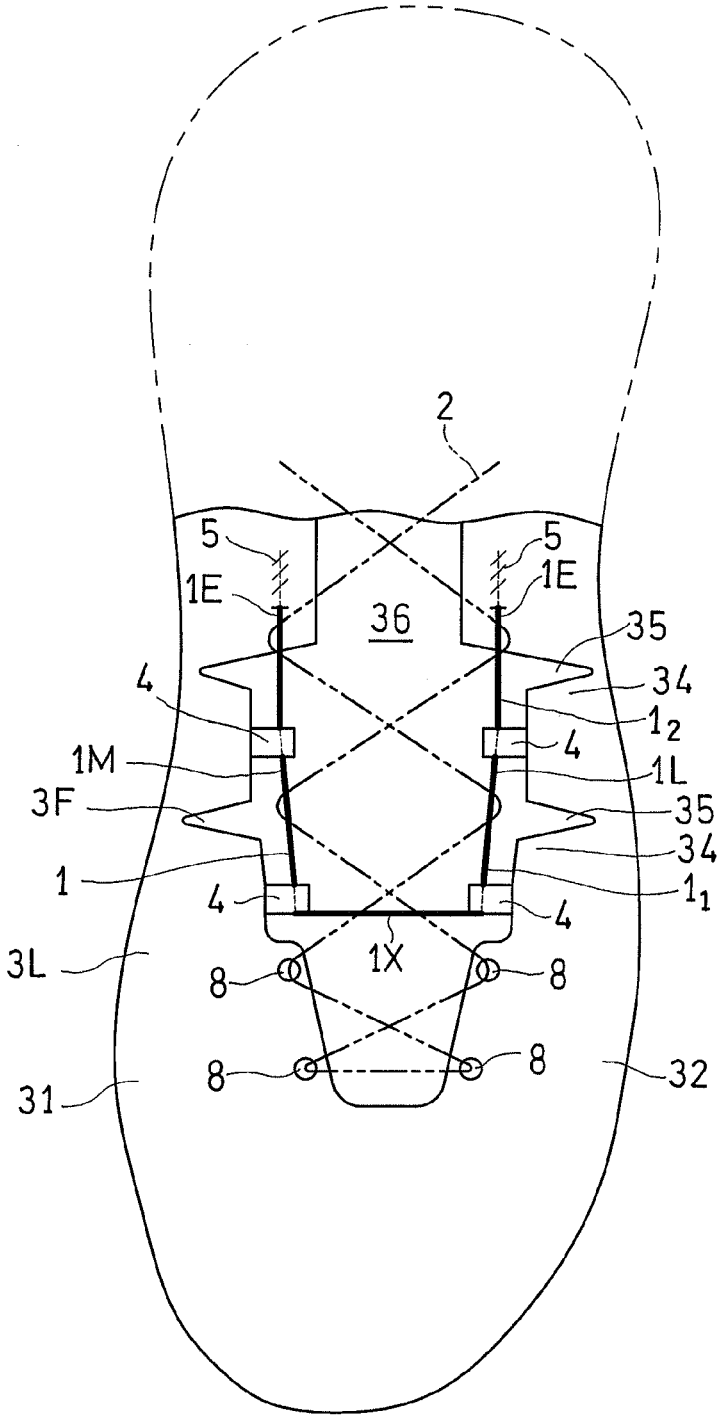
FIG. 9 is a conceptual plan view showing a lacing structure according to Embodiment 4.

FIG. 9 shows a structure of Embodiment 4.

In the present embodiment, the medial side portion 31 and the lateral side portion 32 are each provided with a plurality of through holes 8 through which the second shoelace 2 is inserted. In this case, the second shoelace 2 will come into contact with the fabric of the upper 3 under through hole 8, and will receive a large frictional force at the through hole 8. Therefore, it will more likely prevent the toe from being too tightened as shown in FIG. 4.

Figure 10:
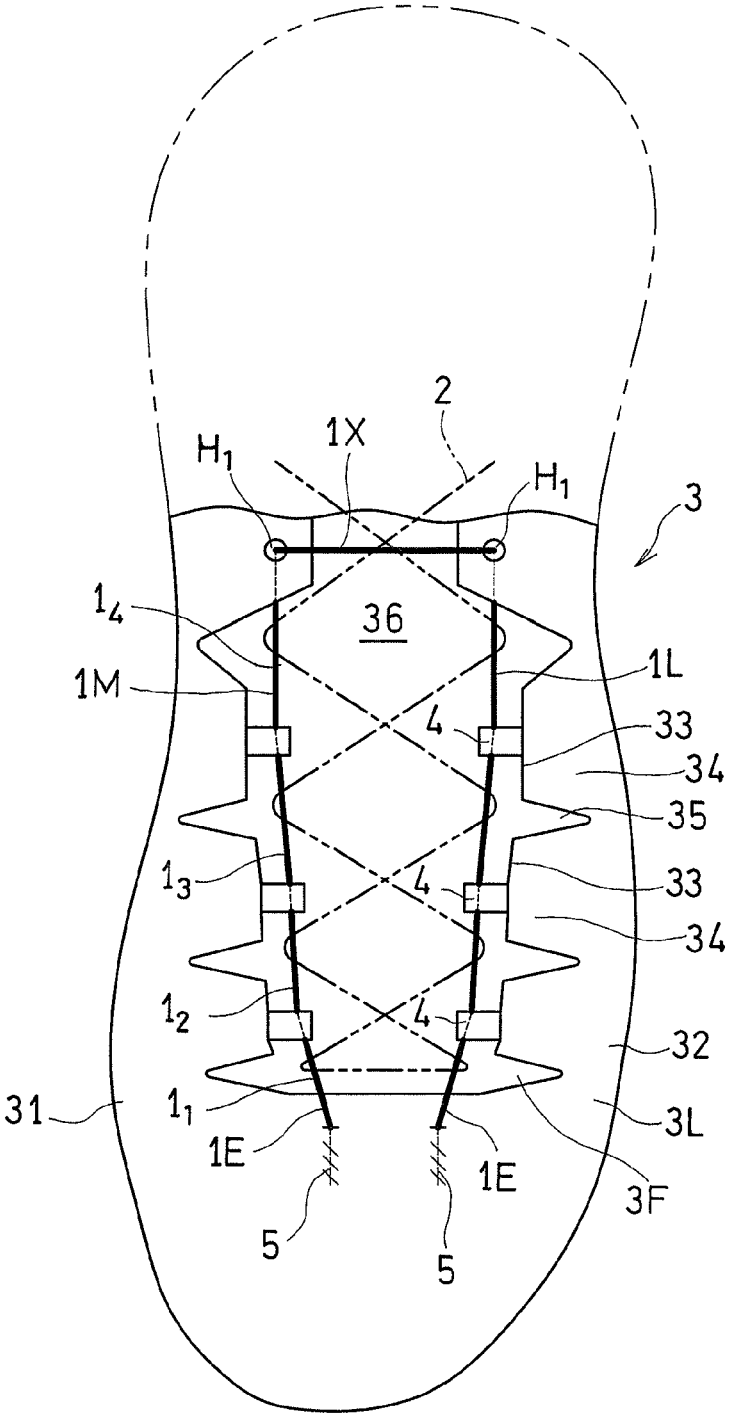
FIG. 10 is a conceptual plan view showing a lacing structure according to Embodiment 5.

Now, the secured portions 5 of the first shoelace 1 may be provided even more anterior to the most anterior loop members 4, i.e., in the front portion, as shown in FIG. 10.

Figure 11:
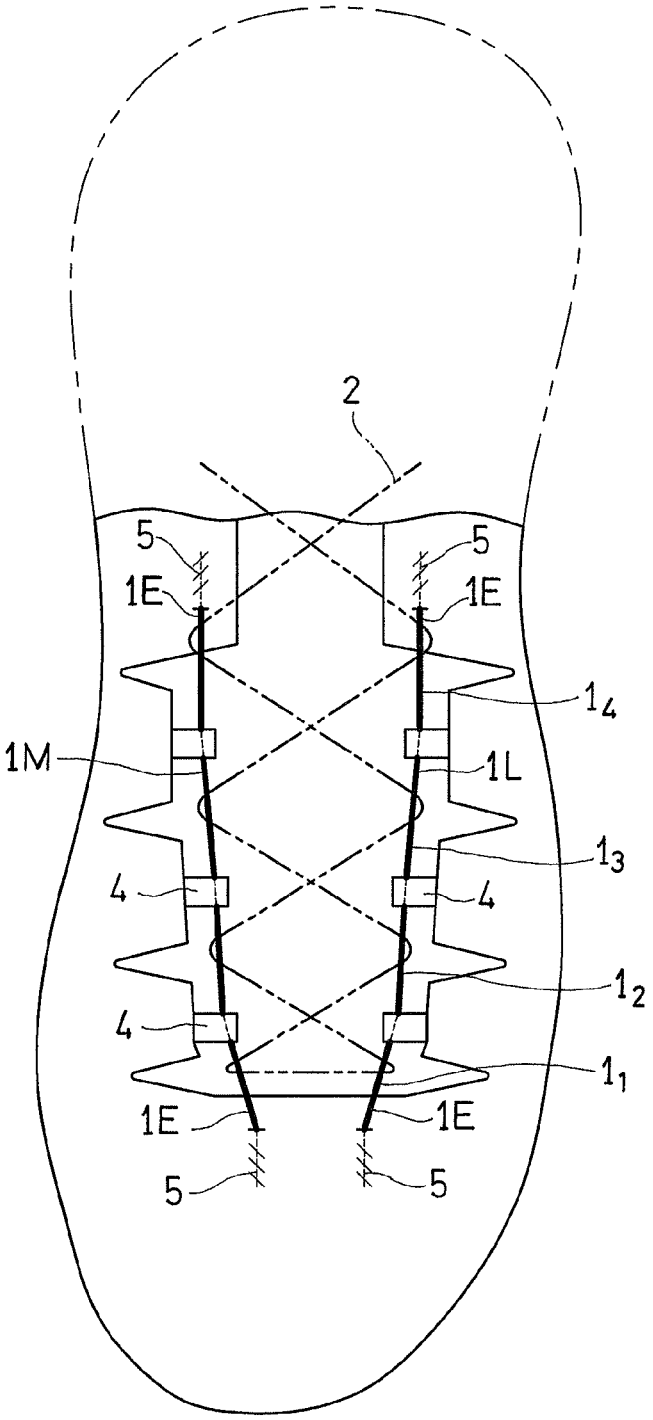
FIG. 11 is a conceptual plan view showing a lacing structure according to Embodiment 6.

The first shoelace 1 may be divided into two, medial and lateral, strings, as shown in FIG. 11, in which case the secured portions 5 are provided both in the front portion and in the rear portion.

Figure 12:
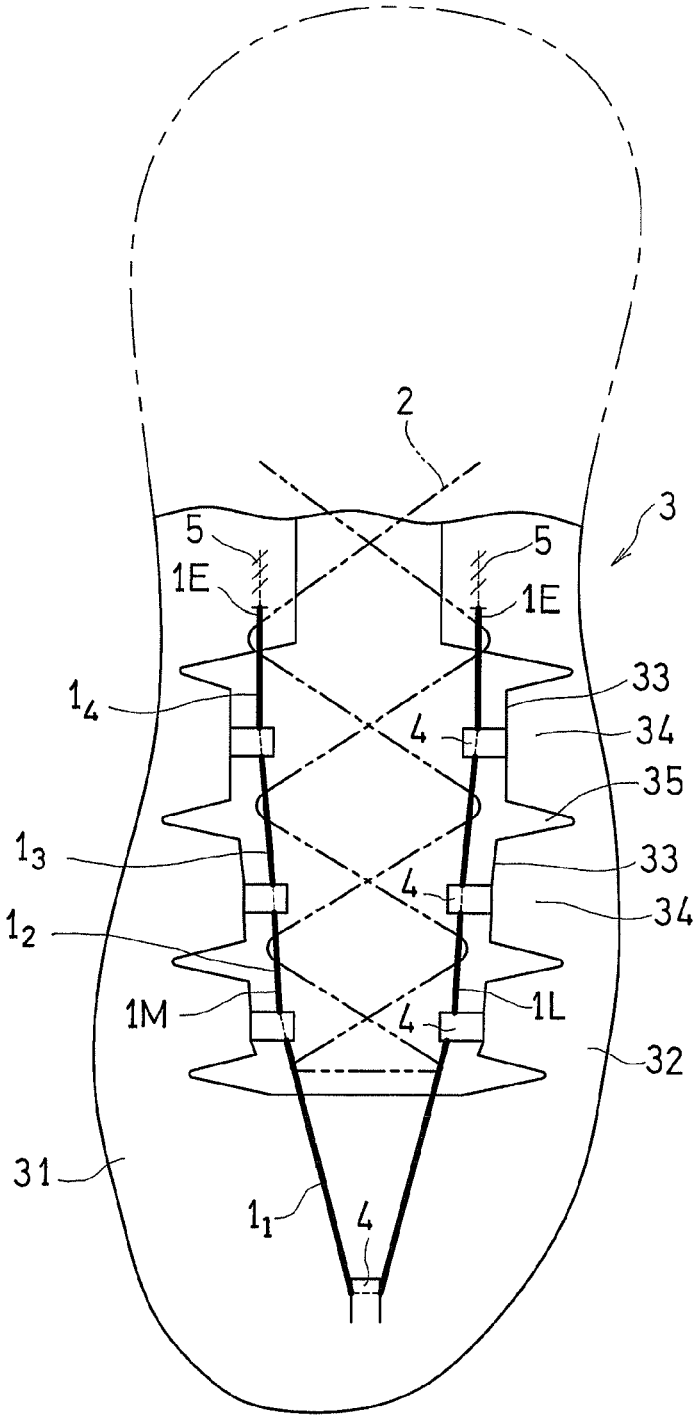
FIG. 12 is a conceptual plan view showing a lacing structure according to Embodiment 7.

A loop member 4 for passing the first shoelace 1 therethrough in the transverse direction X may be provided in the front end of the toe as shown in FIG. 12. In this case, the front-end loop member 4 is lifted up by the first shoelace 1, thereby preventing the toe from being caught on the road surface. Therefore, it may be preferably employed as a wrestling shoe or a shoe for senile people.

Note that this loop member 4 is preferably provided anterior to the second toe interphalangeal joint.

Figure 13:
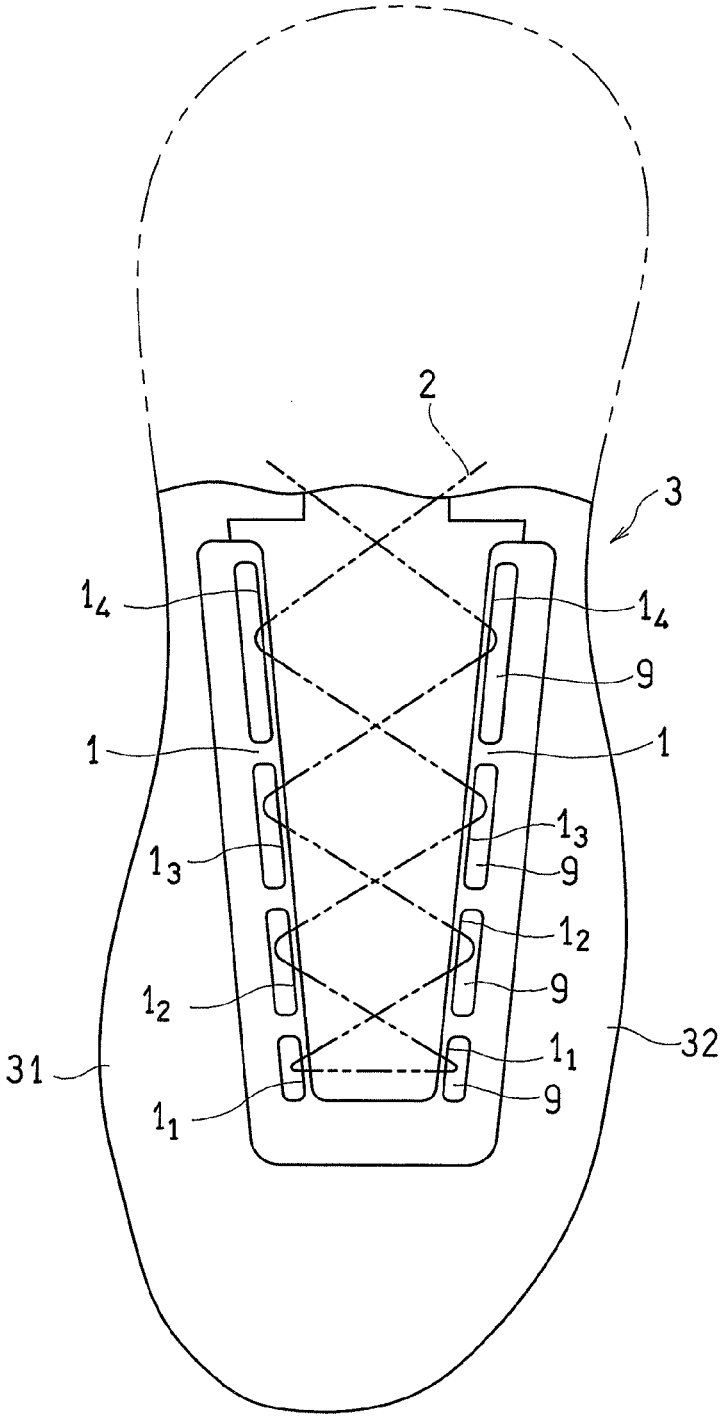
FIG. 13 is a conceptual plan view showing a lacing structure according to Embodiment 8.

In the present invention, engagement means 1 secured to the upper 3 may be employed, as shown in FIG. 13, instead of the first shoelace 1 forming lacing apertures. In this case, the engagement means 1 includes engagement areas $\mathbf{1}_i$ forming a plurality of lacing apertures 9 through which the (second) shoelace 2 is inserted. A soft and bendable material is used for the member forming the engagement areas $\mathbf{1}_i$ placed in the side edge portion. Then, the engagement positions can be displaced in the foot width direction. Note that each lacing aperture 9 is formed by a long aperture elongated in the front-rear direction Y.

While preferred embodiments have been described above with reference to the drawings, various obvious changes and modifications will readily occur to those skilled in the art upon reading the present specification.

For example, the fabric of the upper may only include the non-stretchable member 3L, without the stretchable member 3F. More specifically, a more rigid member may be placed in locations where the non-stretchable member 3L is placed, and a less rigid member may be placed in locations where the stretchable member 3F is placed.

The sole placed under the upper may include a so-called midsole and an outsole.

The upper may be of a low-cut type, rather than a high-cut type.

A tongue extending to the toe may be provided in the central portion of the upper.

Thus, such changes and modifications are deemed to fall within the scope of the present invention, which is defined by the appended claims.

INDUSTRIAL APPLICABILITY

The present invention is applicable to shoes having a lacing structure using a shoelace.

REFERENCE SIGNS LIST

1: First shoelace means (engagement means), 1M: First portion, 1L: Second portion, 1X: Third portion, 1E: End portion, 1*b*: Rear shoelace, 1*f*: Front shoelace, $\mathbf{1}_i$: Exposed area (engagement area)
2: Second shoelace means
3: Upper, 3B: Bottom member, 3F: Stretchable member, 3L: Non-stretchable member, 3K: Cushion member, 31: Medial side portion, 32: Lateral side portion, 33: Edge portion, 34: Protruding portion, 35: Soft portion, 36: Central portion
4: Loop member, 4H: Through hole
5: Secured portion
6: Tongue
7: Top-line
8: Through hole
9: Lacing aperture
H: Through hole
X: Transverse direction
Y: Longitudinal direction
OUT: Lateral direction
IN: Medial direction

The invention claimed is:

1. A lace fitting structure in combination with a shoe having an upper, said upper having a medial side portion and a lateral side portion, said upper configured to wrap around an instep of a foot of a wearer, said combination comprising:

said medial side portion configured to cover medial side surfaces of the instep and a big toe;

said lateral side portion configured to cover lateral side surfaces of the instep and a little toe;

a first shoelace configured to be placed to extend in a longitudinal direction of the shoe along edge portions of the medial side portion and the lateral side portion, and configured to be anterior to a top-line through which the foot is inserted into the upper, the first shoelace engaged with the medial side portion at a plurality of locations and engaged with the lateral side portion at a plurality of locations;

a placement structure configured to place a first portion of the first shoelace on said medial side portion of the shoe anterior to the top-line so that the first portion is exposed in a plurality of medial exposed areas that are separated from one another in the longitudinal direction, the placement structure configured to place a second portion of the first shoelace on said lateral side portion of the foot anterior to the top-line so that the second portion is exposed in a plurality of lateral exposed areas that are separated from one another in the longitudinal direction; and a second shoelace configured to be engaged, in a transverse direction of the shoe, with the first shoelace in the plurality of medial and lateral exposed areas so as to bring the medial side portion and the lateral side portion closer to each other, wherein a length of each of the plurality of medial exposed areas and a length of each of the plurality of lateral exposed areas in the longitudinal direction are greater than a height of the second shoelace and a width of the second shoelace, the placement structure comprises:

three or more insertion parts placed along each of the edge portions of the medial side portion and the lateral side portion, the three or more insertion parts being pierced therethrough in the longitudinal direction, and the first shoelace being inserted through the three or more insertion parts so as to be movable in the longitudinal direction, one exposed area of the plurality of medial exposed areas being defined between one pair of insertion parts of the three or more insertion parts, the one pair of insertion parts being placed along the edge portion of the medial side portion and adjacent to each other in the longitudinal direction, another exposed area of the plurality of medial exposed areas being defined between another pair of insertion parts of the three or more insertion parts, the other pair of insertion parts being placed along the edge portion of the medial side portion and adjacent to each other in the longitudinal direction, one exposed area of the plurality of lateral exposed areas being defined between one pair of insertion parts of the three or more insertion parts, the pair of insertion parts being placed along the edge portion of the lateral side portion and adjacent to each other in the longitudinal direction, another exposed area of the plurality of lateral exposed areas being defined between another pair of insertion parts of the three or more insertion parts, the other pair of insertion parts being placed along the edge portion of the lateral side portion and adjacent to each other in the longitudinal direction;

secured portions for securing end portions of the first shoelace at least in the medial side portion and the lateral side portion;

the medial side portion and the lateral side portion each include at least one through hole which is running through the medial side portion or the lateral side portion in a direction of the height and through which the second shoelace is inserted;

the at least one through hole in each of the medial side portion and the lateral side portion is located posterior to a most posterior insertion part of the three or more insertion parts and posterior to the secured portion in each of the medial and lateral side portions;

the second shoe lace is in contact with a part of an outer surface of the medial side portion and a part of an inner surface of the medial side portion, the at least one through hole is placed more medially than the part of the outer surface and the part of the inner surface of the medial side portion;

the second shoe lace contacts a part of an outer surface of the lateral side portion and a part of an inner surface of the lateral side portion, the at least one through hole is placed more laterally than the part of the outer surface and the part of the inner surface of the lateral side portion;

the second shoe lace is engaged with an edge of the at least one through hole in the medial side portion; and the second shoe lace is engaged with an edge of the at least one through hole in the lateral side portion, and wherein the upper comprises:

a stretchable member that is configured to cover the medial side surface and the lateral side surface of the instep of the shoe in an area anterior to the most posterior insertion part, the stretchable member being stretchable in the longitudinal direction and the transverse direction;

a non-stretchable member that is attached to a surface of the stretchable member, is less stretchable than the stretchable member, and forms a portion of the medial side portion and the lateral side portion;

a plurality of protruding portions of the non-stretchable member configured to project toward a center of the instep of the shoe, the protruding portions being provided by a wave-shape formation of the edge portions of the non-stretchable member in the medial side portion and the lateral side portion; and a soft portion formed by the stretchable member between protruding portions adjacent to each other, which is not covered by the non-stretchable member and in which the stretchable member is exposed, wherein the insertion parts are provided at the edge portions of the protruding portions.

2. The lace fitting structure according to claim 1, wherein the at least one through hole in the medial and lateral side portions each includes a through hole, of which an inner diameter is smaller than the width of the first shoelace.

3. The lace fitting structure according to claim 2, wherein the through hole, of which the inner diameter is smaller than the width of the first shoelace is arranged posterior to the secured portion in the medial and lateral side portions.

4. The lace fitting structure according to claim 1, wherein the opposite end portions of the first shoelace are secured by sewing to the upper at the secured portions in the medial and lateral side portions.

5. The lace fitting structure according to claim 1, wherein each of the protruding portions is formed in a trapezoidal shape tapered toward a center of the upper.

6. The lace fitting structure according to claim 5, wherein:

each of the protruding portions is formed in a trapezoidal shape tapered toward a center of the upper; and a notch is defined between a pair of protruding portions of the protruding portions.

7. The lace fitting structure according to claim 6, wherein in an area anterior to the most posterior insertion part, the upper is sock-shaped and is configured to be continuous along a circumference of the foot.

8. The lace fitting structure according to claim 1, wherein the plurality of medial and lateral exposed areas includes an anterior exposed area and a posterior exposed area posterior to the anterior exposed area, and a length of the posterior exposed area in the longitudinal direction is greater than a length of the anterior exposed area in the longitudinal direction.

9. The lace fitting structure according to claim 8, wherein the length of the posterior exposed area is greater than the length of the anterior exposed area by 2 mm or more.

10. The lace fitting structure according to claim 9, wherein the plurality of medial and lateral exposed areas include $1^{st}$ to $n^{th}$ areas arranged from the front portion to the rear portion and separated from one another in the longitudinal direction, and a length in the longitudinal direction of an arbitrary $(i+1)^{th}$ area from an anterior side is greater than a length in the longitudinal direction of an arbitrary $i^{th}$ area from the anterior side.

11. The lace fitting structure according to claim 1, wherein the first shoelace is formed by one or two round strings, the second shoelace being formed by one or two belt-like strings.

12. The lace fitting structure according to claim 1, wherein the first shoelace is formed by at least one string formed in a U-shaped pattern having a third portion, the third portion extending in the transverse direction and connecting between the first portion and the second portion.

13. The lace fitting structure according to claim 1, wherein the first shoelace includes two strings, each of the two strings forming a U-shaped pattern having a third portion, the third portion extending in the transverse direction and connecting the first portion with the second portion, one of the two strings being configured to be placed toward a toe of the wearer in the longitudinal direction of the shoe, another one of the two strings being configured to be placed toward the top-line in the longitudinal direction of the foot shoe.

* * * * *